United States Patent [19]

Yagii

[11] Patent Number: 4,758,139

[45] Date of Patent: Jul. 19, 1988

[54] SIDE HOUSING FOR A ROTARY PISTON ENGINE AND A METHOD FOR MANUFACTURING THE SAME

[75] Inventor: Koji Yagii, Hiroshima, Japan

[73] Assignee: Mazda Motor Corporation, Hiroshima, Japan

[21] Appl. No.: 925,243

[22] Filed: Oct. 30, 1986

[30] Foreign Application Priority Data

Oct. 30, 1985 [JP] Japan ..... 60-243111
Oct. 31, 1985 [JP] Japan ..... 60-244839

[51] Int. Cl.[4] ..... F01C 21/00

[52] U.S. Cl. ..... 418/178; 29/156.4 WL; 29/458; 29/527.2

[58] Field of Search ..... 29/156.4 WL, 527.1, 29/527.2, 458, DIG. 39; 416/196, 197; 418/61 A, 178; 123/193 C, 668

[56] References Cited

U.S. PATENT DOCUMENTS 3,289,649 12/1966 Lamm ..... 123/193 C
3,833,321 9/1974 Telang et al. ..... 418/178
3,878,880 4/1975 Jones ..... 29/156.4 WL X
3,888,746 6/1975 Uy et al. ..... 29/156.4 WL X
3,918,137 11/1975 Telang et al. ..... 418/178 X
3,942,917 3/1976 Wieland ..... 418/178 X
3,981,688 9/1976 Telang et al. ..... 29/156.4 WL
4,337,735 7/1982 Lichtner et al. ..... 123/668 X
4,549,862 10/1985 Stich et al. ..... 418/178 X

FOREIGN PATENT DOCUMENTS 46-20083 7/1971 Japan .

*Primary Examiner*—Timothy V. Eley
*Assistant Examiner*—Irene Cuda
*Attorney, Agent, or Firm*—Fleit, Jacobson, Cohn & Price

[57] ABSTRACT

A method for manufacturing a side housing of a rotary piston engine including the steps of forming a flame sprayed layer on the rotor sliding portion of the inner surface thereof and forming an anodized layer on a portion of the inner surface with the exception of the rotor sliding portion so as to eliminate a jamming of whetstone employed for an abrading process.

13 Claims, 2 Drawing Sheets

SIDE HOUSING FOR A ROTARY PISTON ENGINE AND A METHOD FOR MANUFACTURING THE SAME

BACKGROUND OF THE INVENTION

1. Field of the invention

The present invention relates to a rotory piston engine and a method for manufacturing the same. More specifically, the present invention pertains to a side housing made of an aluminum alloy having an inner surface covered with a hard ceramic material so as to improve a wear resistant property.

2. Description of the prior art

Conventionally, it is known to employ an aluminum alloy for a side housing of rotary piston engines in order to lighten the engine. It should, however, be noted that the aluminum alloy is relatively soft in hardness and, therefore, disadvantageous in the wear resistant property. Specifically, since a high wear resistant property is needed for the side housing of the rotary piston engine, it is necessary to provide means for improving a wear resistant property in the aluminum alloy side housing. For this purpose, Japanese Utility Model Publication No. 46-20083 published for opposition on July 13, 1971, discloses a side housing having an inner surface thereof covered with a flame sprayed layer of a hard metallic material whereby the side housing is brought into contact with sealing members of a rotor.

In the side housing as disclosed in the Japanese Utility Model Publication, since craters are produced through the flame spraying process to hold a lubricating oil therein to thereby provide an appropriate oil supply effect into the combustion chamber, it is desirable that the surface of the flame sprayed layer have a certain roughness in order to obtain an appropriate lubricating effect between the surface of the side housing and the sealing members of the rotor. It should, however, be noted that the surface of the flame sprayed layer is so rough as to cause undesirable wear of the sealing member. Therefore, the surface is not suitable for the inner surface of the side housing. Accordingly, it is necessary to face the portion of the surface so as to obtain an appropriate roughness thereof. It should further be noted that such hard materials are generally very expensive in comparison with other materials such as aluminum matrix of the side housing. Therefore, it is desirable to reduce the amount of the material used for the flame sprayed layer as much as possible. Under these circumstances, it has been proposed that the flame sprayed layer of a hard material is formed on only a portion of the inner surface of the side housing wherein the portion is brought into contact with the sealing members of the rotor and thereafter a certain facing treatment is applied to the portion by means of a diamond whetstone or the like in order to obtain an appropriate roughness thereof.

However, in the case where this method is applied for a side housing made of the aluminum alloy, the whetstone is inevitably brought into contact with not only the hard flame sprayed layer but also the soft aluminum alloy matrix exposed adjacent to the portion covered with the hard flame sprayed layer so that there may occur a jamming of the whetstone during the facing treatment to thereby hurt the faced surface of the side housing and affect an operation of the whetstone.

SUMMARY OF THE INVENTION

It is therefore an object of the present invention to provide a method for manufacturing a side housing for a rotary piston engine having a sufficient wear resistant property.

It is another object of the present invention to provide a method for manufacturing a side housing which is light in weight.

It is a further object of the present invention to provide a method for manufacturing a side housing which is inexpensive.

It is a further object of the present invention to provide a side housing having the above advantages.

According to the present invention, the above and other objects can be accomplished by a method for manufacturing a side housing for rotary piston engine including the steps of preparing a side housing blank of a aluminum alloy having an inner surface, forming a flame sprayed layer of a hard material, such as a ceramic material or the like on a rotor sliding portion of said surface of the matrix wherein said portion is brought into engagement in rubbing contact relationship with sealing members of a rotor, forming an anodized coating such as aluminum on at least the other portion of the inner surface of the side housing wherein said other portion is adjacent to the rotor sliding portion, thereafter applying an abrading treatment to the side housing.

In forming the flame sprayed layer, a flame spraying may be applied to the rotor sliding portion of the side housing and thereafter an anodizing process is applied to a portion of the surface of the side housing with the exception of the rotor sliding surface. Alternatively, the flame sprayed layer can be formed in a manner that the anodizing process is applied to form the anodized aluminum layer throughout the inner surface of the side housing and the formed anodized layer is removed by means of an abrading process in the portion of the inner surface with the exception of the rotor sliding portion, and thereafter the flame spraying process is applied to the rotor sliding surface, finally the abrading treatment is applied to the rotor sliding portion.

In the rotary piston engine, a certain amount of lubricating oil is supplied into the combustion chamber so as to obtain an appropriate lubricating effect for the movable members of the engine. An excessive facing treatment can improve the lubricating effect. However, it results in an increase of oil consumption. Therefore, the abrading treatment is so applied that the abraded surface has a certain roughness to thereby provide a desirable oil holding effect without such increase of the oil consumption.

In a preferred mode, a coating layer is formed on an oil seal sliding portion of the rotor sliding portion in order to obtain a smoothness thereof wherein an oil seal member formed on the rotor is brought into engagement in rubbing contact relationship with the oil seal sliding portion.

For the flame spraying material, $Cr_3C_2$—25NiCr, $Al_2O_3$,$Cr_3C_2$—20Ni,$Cr_2O_3$WC—Co(Co15 wt %),Mo,80C(0.8 wt %C-Fe) and the like may be employed. It is preferrable that after the facing treatment of the flame sprayed layer, an ultrasonic cleaning process is applied, thereafter a coating is formed on the flame sprayed layer. As for the coating material, fluorine plastic including modified fluorine plastic and thermoset fluorine plastic, such as polytetrafluoroethylene can be employed but the modified fluorine plastic is preferrable. These materials for coating are employed together with a binder, pigment and solvent.

According to the features of the present invention, there is formed a hard flame sprayed layer of a wear resistant material such as ceramic on the rotor sliding portion of the inner surface of the side housing. The flame sprayed layer has a certain roughness so that the side housing can obtain an appropriate oil holding effect as well as a wear resistant property.

There is formed an anodized aluminum layer on the surface of the side housing except the rotor sliding portion. Since the anodized aluminum layer is harder than the aluminum matrix, there occurs no problem such as jamming of the whetstone in the facing process.

Further, there is formed a coating layer so as to smooth the surface on the oil seal sliding portion of the rotor sliding portion so that an appropriate sealing effect can be obtained between the oil seal member of the rotor and the side housing. That is, an oil leak phenomenon to the combustion chamber through the oil seal member can be effectively suppressed.

The present invention will be described with reference to examples.

Figure 1:
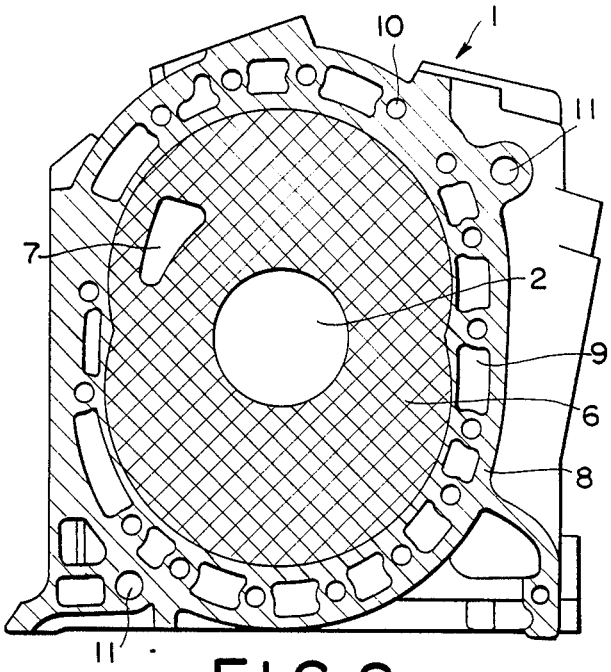
FIG. 1 is a side view of a side housing showing a rotor sliding portion and an anodized aluminum area in accordance with the present invention.
Figure 2:
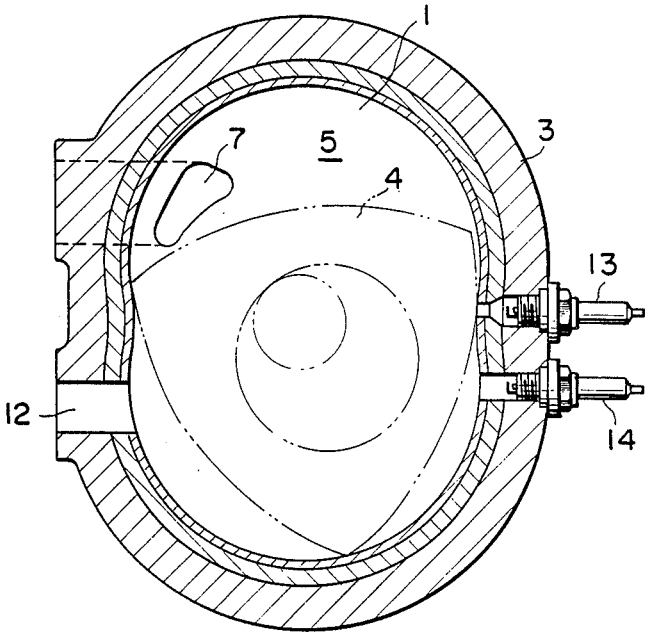
FIG. 2 is a sectional view of a rotary piston engine in accordance with the present invention.

Referring now to FIG. 1 and FIG. 2, there is shown a rotary piston engine for which the present invention can be applied. The engine is provided with a side housing 1 formed with a hole 2 through which a rotation shaft of the engine is inserted and a rotor housing 3 wherein the side housing 1 and rotor housing 3 define a rotor chamber 5 for receiving a rotor 4 therein. The side housing 1 is formed with a rotor sliding surface 6 in the peripheral portion of the hole 2. Side seal members mounted on the rotor 4 are brought into engagement in rubbing contact relationship with the rotor sliding surface 6. The side housing is further formed with a side intake port 7 in the rotor sliding surface 6. The side housing 1 is provided with an engaging surface 8 outside the rotor sliding surface 6 through which the side housing 1 is connected with the rotor housing 3. In the engaging surface 8, there are formed water jackets 9, holes 10 for inserting tension bolts, and holes 11 for inserting positioning bolts thereto respectively. The rotor housing 3 is provided with an exhaust port 12. Ignition plugs 13 and 14 are adapted to be inserted in the rotor housing 3.

EXAMPLE 1

T-6 treatment was applied to a cast aluminum alloy blank (AC 4A) for the side housing. In the T-6 treatment, the blank was maintained at 520° C. for 5 hours and hardened by employing water, thereafter tempered at 180° C. for 6 hours and aircooled. An anodizing process was applied to the rotor sliding surface 6 and the engaging surface 8 to form an anodized aluminium layer with a thickness of 80 microns thereon. In turn, an abrading treatment was applied to the rotor sliding surface 6 to form a recess having a depth of 200 microns. Thereafter, a degreasing and in turn a shot blasting were applied to the rotor sliding surface 6. Further, $Cr_3C_2$—25NiCr was flame-sprayed to the rotor sliding surface 6 to form a flame sprayed layer of a thickness of 250 microns by employing a plasma flame spraying device (produced by METECO CO. as a trademark of 7MB type). A rough and fine facing treatment was applied to the side housing 1 by employing two kinds of diamond whetstones (produced by HITACHI as SDC200N75BW4 for a rough grinder and SDC700N75BW4 for fine grinder) to form a flame sprayed layer of 150 microns in thickness. The facing treatment was also applied to the engaging surface 8 to abrade by 60 microns in thickness so as to have a same level as the rotor sliding surface 6.

In the facing treatment, there occurred no problem such as a jamming of the diamond whetstones or scratches in the ground surface. After the facing treatment, the rotor sliding surface 6 and the engaging surface 8 have Ra of 0.5 and 0.3 in roughness, respectively.

Figure 4:
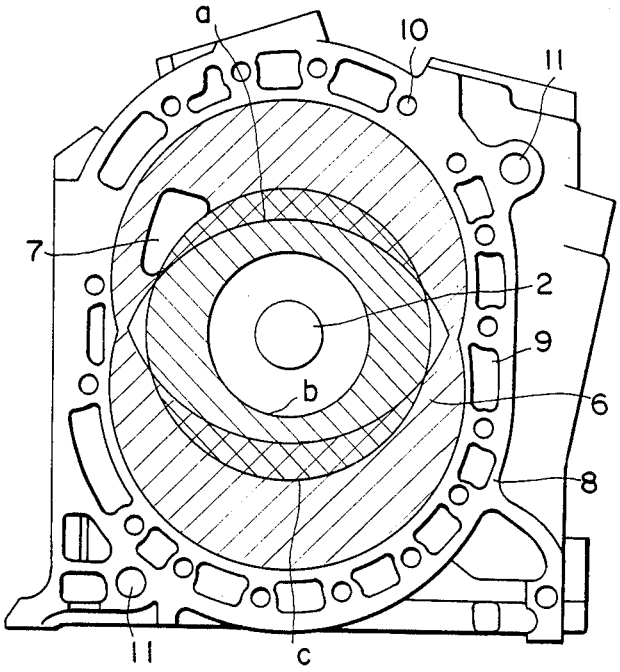
FIG. 4 is a side view of side housing of a further embodiment in accordance with the present invention.

Thereafter, a fluorine plastic (produced by DAIKIN INDUSTRIES CO. as TOUGH COAT ENAMEL TC-7408GY) is applied to the oil seal sliding portion covering the other portion of the inner surface of the side housing 1. In FIG. 4, there is shown the oil seal sliding portion as defined by line b and line c where the oil seal member of the rotor is brought into engagement with the side housing 1. The line a shows an inner end of an area where the side seal member of the rotor is brought into engagement with the side housing 1. In the coating process, the fluorine plastic was applied to be immersed into craters formed through the flame spraying process. An excessive coating material was wiped away from the surface. Thereafter, the solvent of the material was volatilized at 80° C. for 20 hours. The material was calcined at 160° C. for 30 hours to form the coating layer.

EXAMPLE 2

Figure 3:
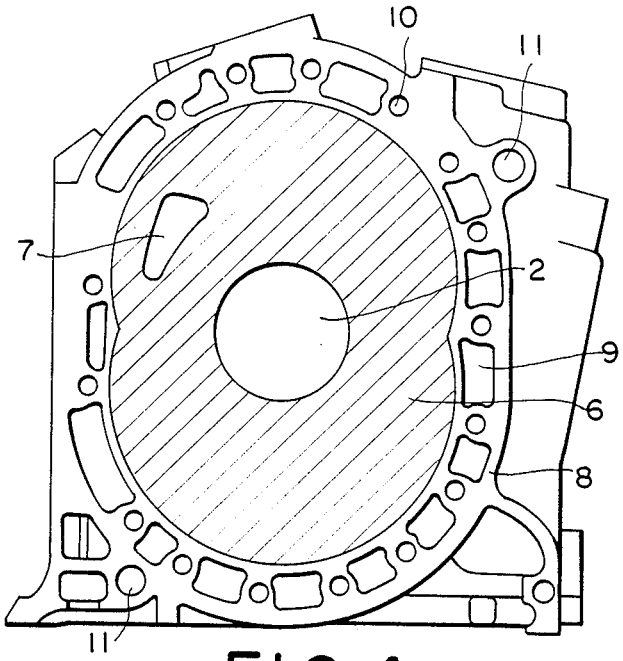
FIG. 3 is a side view of a side housing of another embodiment in accordance with the present invention.

A cast aluminum alloy blank (AC4AT6) for a side housing was abraded for the rotor sliding surface 6, as shown in FIG. 3 as a hatched portion, to form a recess of 200 microns in depth. A flame spraying process was applied to the ground portion by employing the same material as in Example 1 to form a flame sprayed layer of 250 microns in thicknes. Masking the area where the flame sprayed layer was formed, an anodizing process was applied to an area outside of the rotor sliding surface, that is, the engaging surface 8 to form an anodized aluminum layer of 150 microns. Thereafter the same processes as in Example 1 were applied. As in Example 1, no problems occurred in obtaining a good finish of the surface in the facing process.

EXAMPLE 3

A side housing was produced in accordance with the method of Example 1 with the exception that $Al_2O_3$ was employed as the flame spraying material. In the facing process, there no problems occurred.

COMPARATIVE EXAMPLE 1

A cast aluminum alloy blank as described in Example 1 was abraded for the rotor sliding surface 6 to form a recess of 200 microns in depth. Then a flame sprayed layer was formed on the abraded portion. Thereafter, a facing process was applied to the side housing blank to form a flat surface throughout the inner surface of the side housing. In the facing process, there occurred a jamming of the diamond whetstone and a seizing of the aluminum powder. Further there were produced many scratches on the treated surface.

In this example, a coating layer was not formed on the oil seal sliding surface.

COMPARATIVE EXAMPLE 2

A side housing was produced in accordance with the method of comparative Example 1 with the exception of the material for the flame spraying process. In this example, $Al_2O_3$ was used instead of $Cr_3C_2$—25NiCr. There occurred the same problem as in comparative Example 1.

With regard to the engines constituted by employing the side housing of the Examples 1 and 3 and comparative Examples 1 and 2, the amount of the oil consumption was measured.

Testing conditions

Engine: 13B with turbo super charger, 200PS.

Operating condition: 1 test cycle includes an operation of 1500 rpm, no load, 20 seconds, and an operation of 7000 rpm, full load, 1.25 minutes. The ccle is repeated 6000 times for each engine.

Material of the side seal member: Fe-3% C, calendared material of sintered alloy.

Ratio of lubricating oil between a direct oil which is supplied to the combustion chamber and a separate oil which is mixed with the intake air: 50:50.

The results of the test are shown in Table 1.

TABLE 1

| Side Housing | Oil Consumption | Judge |
|---|---|---|
| Flame Spray ($Cr_3C_2$—20NiCr) (Comparative 1) | 0.78 l/H | X |
| Flame Spray ($Al_2O_3$) (Comparative 2) | 0.86 l/H | X |
| Flame Spray ($Cr_3C_2$—20NiCr) + Fluorine Plastic Coating (Example 1) | 0.24 l/H | O |
| Flame Spray ($Al_2O_3$) + Fluorine Plastic Coating (Example 2) | 0.27 l/H | O |

I claim:

1. A method for manufacturing a side housing for a rotary piston engine including the steps of preparing a side housing blank of an aluminum alloy having an inner surface; forming a flame sprayed layer of a hard material on a rotor sliding portion of said inner surface of the side housing wherein said rotor sliding portion is to be brought into engagement in rubbing contact relationship with sealing members of a rotor, forming an anodized coating on at least an other portion of the inner surface of the side housing, said other portion being adjacent to the rotor sliding portion; and thereafter applying an abrading treatment to said inner surface of the side housing.

2. A method for manufacturing a side housing in accordance with claim 1 further including a step of forming a coating layer on an oil seal sliding portion of said rotor sliding portion in order to obtain a smoothness thereof, wherein an oil seal member formed on the rotor is brought into engagement in rubbing contact relationship with the oil seal sliding portion.

3. A method for manufacturing a side housing in accordance with claim 1 including the steps of, in the following sequence, forming the anodized coating on the whole inner surface of the side housing, abrading the anodized coating on the rotor sliding portion to form a recess, forming the flame sprayed layer on the rotor sliding portion, and thereafter applying the abrading treatment to the inner surface of the side housing.

4. A method for manufacturing a side housing in accordance with claim 1 including the steps of, in the following sequence, forming a recess in the rotor sliding portion of the inner surface, forming the flame sprayed layer on the rotor sliding portion, forming an anodized coating on the inner surface except the rotor sliding portion, and abrading the inner surface.

5. A method for manufacturing a side housing in accordance with claim 3 including a step of applying a shot blasting to the recess formed in the rotor sliding portion of the inner surface.

6. A method for manufacturing a side housing in accordance with claim 1 in which said hard material is a ceramic material.

7. A method for manufacturing a side housing in accordance with claim 6 in which said ceramic material is selected from the group consisting of $Al_2O_3$,$Cr_2C_2$—$N_2$, and $Cr_2O_3$—WC—Co based ceramics.

8. A method for manufacturing a side housing in accordance with claim 1 in which said hard material is Mo.

9. A method for manufacturing a side housing in accordance with claim 1 wherein said hard material is Fe including C of 0.8 wt %.

10. A method for manufacturing a side housing in accordance with claim 1 in which a diamond whetstone is employed for the abrading treatment.

11. A method for manufacturing a side housing in accordance with claim 2 in which fluorine plastic is used for the coating layer.

12. A side housing for a rotary piston engine including an aluminum alloy matrix having an inner surface, a flame sprayed layer of a hard material formed on a rotor sliding portion of said inner surface wherein sealing members mounted on a rotor are brought into engagement in rubbing contact relationship with the rotor sliding portion, and an anodizing layer formed on the inner surface except the rotor sliding portion, the inner surface being abraded so as to obtain a certain smoothness thereof.

13. A side housing in accordance with claim 12 in which a coating layer is formed on the flame sprayed layer of an oil sealing portion of the rotor sliding portion wherein oil seal members mounted on the rotor are brought into engagement in rubbing contact relationship with the oil seal sliding portion.

* * * * *